US005786297A

United States Patent [19]

Edwards

[11] Patent Number: 5,786,297

[45] Date of Patent: Jul. 28, 1998

[54] THERMAL TRANSFER PRINTING RECEIVER SHEET

[75] Inventor: Paul Andrew Edwards, Essex, United Kingdom

[73] Assignee: Imperial Chemical Industries PLC, United Kingdom

[21] Appl. No.: 696,923

[22] PCT Filed: Feb. 24, 1995

[86] PCT No.: PCT/GB95/00402

§ 371 Date: Oct. 8, 1996

§ 102(e) Date: Oct. 8, 1996

[87] PCT Pub. No.: WO95/23066

PCT Pub. Date: Aug. 31, 1995

[30] Foreign Application Priority Data

Feb. 25, 1994 [GB] United Kingdom ..... 9403663

[51] Int. Cl.[6] ..... B41M 5/035; B41M 5/38

[52] U.S. Cl. ..... 503/227; 428/195; 428/480; 428/500; 428/502; 428/522; 428/913; 428/914

[58] Field of Search ..... 8/471; 428/195, 428/913, 914, 480, 500, 502, 522

[56] References Cited

U.S. PATENT DOCUMENTS 5,290,750 3/1994 Kushi et al. ..... 503/227

*Primary Examiner*—Bruce H. Hess

[57] ABSTRACT

A receiver sheet for diffusion transfer printing comprising a substrate having thereon a dye receiver layer comprising a dye receptive polymer and the reaction product of a first compound, which is a resin, having at least two reactive functional groups and a second, fluorine containing compound having a single reactive functional group.

8 Claims, No Drawings

THERMAL TRANSFER PRINTING RECEIVER SHEET

This invention relates to a thermal transfer printing (TTP) receiver sheet.

Thermal transfer printing is a printing process in which a dye is caused, by thermal stimuli, to transfer from a dye sheet to a receiver sheet. In such processes, the dye sheet and receiver sheet are placed in intimate contact, the thermal stimuli are applied to the dye sheet and the dye sheet and receiver sheet are then separated. By applying the thermal stimuli to pre-determined areas in the dye-sheet, the dye is selectively transferred to the receiver to form the desired image.

Receiver sheets conventionally comprise a substrate with a dye-receiving polar surface on one side, into which a dye is thermally transferable and retainable. Where the substrate is itself polar and capable of receiving a dye, the dye may be transferred directly to a surface of the substrate. However receiver sheets typically comprise a substrate supporting a receiver layer specifically tailored to receive the dye. However, such systems have the problem that the high temperatures (250°–350° C.) involved in the dye transfer, can cause the dye sheet and the receiver sheet to melt bond together preventing clean separation and in extreme cases preventing any separation.

It is known that this problem can be overcome by incorporating release agents such as silicone and fluorine containing compounds, for example fluoro surfactants, in the receiver sheet.

However, as disclosed in EP 424037, the use of such conventional materials leads to bleeding (pressure transfer) of the dye from the dye sheet to the receiver sheet, ie the dye can migrate as soon as the dye sheet and the receiver sheet are brought together.

There is also a tendency for the amount of release agent to be reduced by transfer to the dye sheet such that in multicolour printing there is insufficient remaining in the final print operation to prevent bonding. Any increase in the amount of release agent to counteract this effect would of course increase dye bleeding.

EP 424037 suggests that the problem may be overcome by using release agents capable of forming a cross-linked structure and points out that conventionally used fluoro surfactants totally lack the ability to cross-link and that the release agents must contain either an unsaturated functional group (eg vinyl) or at least two separate functional groups for sufficient cross-linking to take place.

Unfortunately, such cross-linking affects the "writability" of the surface, that is to say the acceptance by the surface of the various inks used in common writing implements, in particular aqueous based inks which are being increasingly used for environmental reasons. Writability is particularly important in the medical field where notes may need to be written on a patient's records.

Whilst the receiver sheets disclosed in EP 424037 may have improved properties in terms of release and dye bleeding, there is also the disadvantage that the release agents suggested are not readily available; indeed no specific example of a cross-linkable fluoro compound is given.

It is an object of this invention to provide a receiver sheet which has appropriate release properties, is capable of accepting ink, particularly aqueous based inks, from common writing implements, which does not suffer from pressure transfer of dye and which can use materials which are readily available commercially.

According to one aspect of the invention, there is provided a receiver sheet for diffusion transfer printing comprising a substrate having thereon a dye receiver layer comprising a dye receptive polymer and the reaction product of a first compound having at least two reactive functional groups and a second, fluorine containing, compound having a single reactive functional group.

The reaction product has reduced mobility and hence reduces transfer to the dye sheet during printing without producing a cross-linked surface which would prevent penetration of ink and reduce writability.

The first compound may be an amine resin, preferably a melamine resin such as hexamethoxy methyl melamine (HMMM).

Preferably, an acid such as p-toluene sulphonic acid or di-nonylnaphthalene disulphonic acid is present to catalyse the reaction. The combination of HMMM and sulphonic acid catalyst reduce the likelihood of self-condensation reaction taking place between the methoxy groups of the melamine.

Alternatively, the first compound may be an isocyanate such as the biuret of hexamethylene diisocyanate.

Preferably, the functional group of the fluorine containing compound is a hydroxy or thiol group.

Preferred fluoro compounds having monofunctionality have the formula

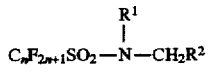

where $R^1$ is an alkyl or substituted alkyl group having from 1 to 6 carbon atoms, or an aryl or substituted aryl group;

$R^2$ is —COO—[CH ($CH_3$) $CH_2$ O $CH_2$ $CH_2$O—]$_w$$R^3$, —COO—($CH_2$—$CH_2$—O—)$_x$ $R^3$, or —$CH_2$—O—($CH_2$—$CH_2$—O—)$_y$$R^3$; $R^3$ is H or $R^1$, n is an integer of from 4 to 20; and w, x and y each independently represents an integer of from 2 to 50

Specific fluro compounds include the following:

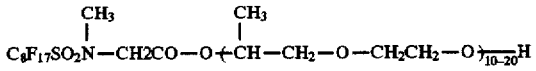

1)

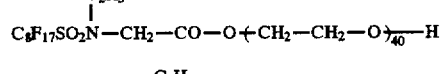

2)

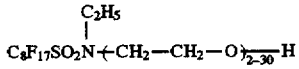

3)

which are supplied commercially by 3M Company as FLUORAD® FC 430, 431 and 170-C respectively.

The amount of the fluorine containing compound present depends on the dye receptive polymer used but may vary between 1 and 20% by weight of such polymer.

The dye receptive polymer may be an amorphous polyester as is conventionally used, but can be a vinyl chloride/vinyl acetate copolymer, a sulphonated polyester or mixtures thereof. The presence of a polyester is desirable as the methoxy groups in the melamine resin can also react with the carboxy groups present in the polyester chain.

The inclusion of the vinyl chloride/vinyl acetate copolymer has the advantage that the amount of fluorine containing compound can be reduced.

Suitable amorphous polyesters are VYLON 103 and VYLON 200 (believed to be formed from terephthalicacid, isophthalic acid, neopentyl glycol and ethylene glycol) and VYLON 290 (believed to be formed from terephthalic acid, isophthalic acid, ethylene glycol and bisphenol A, all available from Toyobo. A suitable copolymer is VINYLITE VYNS-3 which has a chloride/acetate ratio of 90/10 and is available from Union Carbide and suitable sulphonated polyesters are EASTMAN SIZE 29 and EASTMAN SIZE 55 (believed to be ammonium salts of a polyester based on isophthalic acid and 5-sulphoisophthalic acid) and available from Eastman Kodak.

It is, of course important that all the components of the receiver layer are soluble in the commonly used coating solvents such as ethyl methyl ketone, toluene and diacetone alcohol.

Receiver sheet substrates known in the art may be employed in the present invention including cellulose fibre paper desirably with a polymer coating, thermoplastic films for example polyethylene terephthalate (desirably biaxially orientated), filled and/or voided thermoplastic films for example pearl film, and laminates of two or more substrate materials.

If desired the receiver layer may be separated from the substrate by a conventional primer layer known in the art which may be employed for example to improve adhesion of the receiver layer to the substrate.

The coatings applied to the substrate may be applied by conventional coating techniques for example direct gravure coating, reverse gravure coating and using a Meyer bar. The coating may be deposited as a solution or a dispersion as desired from any suitable solvent or solvent mixture.

The invention is illustrated by the following non-limiting examples

EXAMPLE 1

Receiver sheets according to the present invention were produced by reverse gravure coating onto samples of Melinex D969 polyester film available from ICI, the following formulations in a solvent mixture of ethyl methyl ketone, toluene and diacetone alcohol:

| Composition (Parts by Weight) | 1A | 1B | 1C | 1D |
|---|---|---|---|---|
| VYLON 200 | 60 | — | 43 | — |
| VYLON 103 | 40 | — | 37 | — |
| VYLINITE VYNS | — | 100 | 20 | — |
| EASTMAN SIZE 29 | — | — | — | 50 |
| EASTMAN SIZE 55 | — | — | — | 50 |
| FLUORAD FC 431 | 5 | 3 | 4.3 | 10 |
| CYMEL 303 | 5 | 3 | 3.5 | 7 |
| Catalyst | 0.2 | 0.2 | 0.4 | 1 |

[CYMEL 303 is a hexamethoxy methyl melamine (available from American Cyanamid), and the catalyst is an n-butylamine salt of paratoluene sulphonic acid] After coating the receiver sheets were cured at 140° C. for 100 seconds.

EXAMPLE 2

Receiver sheets produced according to Examples 1A to 1D were tested (according to the tests below) to assess various characteristics thereof.

Writeability

Marks were applied to the receiver coat using a variety of pens having different inks including, aqueous based and mixed solvent non-aqueous based and ball-point inks. The marks were then visually observed for their line density and uniformity.

Smudge Test

Ink marks were applied to the receiver coat as in the writability test. The marks were left for a set period and then rubbed with a finger to assess the degree to which the marks smudged.

Melt Bonding:

A receiver sheet was printed to maximum optical density using a standard dye sheet in a Hitachi VY200 printer and examined for evidence of bonding after separation.

Pressure Transfer:

A receiver sheet was pressed against a standard dye sheet for 90 seconds and examined for evidence of ink migration after separation.

| Test | Results<br>Examples 1A, 1B, 1C, 1D |
|---|---|
| Writability: Solvent based ink pens | Good line uniformity and density |
| Writability: Ball-point pens | Good line uniformity and density |
| Writability: Aqueous based ink pens | Good line uniformity and density without any ink retraction |
| Smudge Resistance: Aqueous based ink pens | Good resistance |
| Melt Bonding: | Good Separation |
| Pressure Transfer: | None Evident |

The receiver sheets produced in Example 1 exhibited excellent writeability and smudge properties with aqueous-based, solvent-based and ball-point inks, enabled clean separation after printing and did not suffer from pressure transfer.

EXAMPLES 3 and 4

Example 1 was repeated except that the FLUORAD FC 431 was replaced with FLUORAD FC 430 and FC 170-C. Similar results were obtained.

EXAMPLE 5

Example 1 was repeated except that the FC 431 was replaced by EFTOP® EF 801 ( available from Tohkem Products Corporation) which is an N-alkyl-perfluoroalkylsulphonylamino acrylate/poly(oxyalkylene) acrylate copolymer having multi hydroxy functionality.

Whilst the results of the melt bonding and pressure transfer tests were similar to Example 1, the receiver sheet would not accept aqueous based inks.

I claim:

1. A receiver sheet for diffusion transfer printing comprising a substrate having thereon a dye receiver layer comprising a dye receptive polymer and the reaction product of a first compound, which is a resin having at least two reactive functional groups and a second, fluorine containing, compound having a single reactive functional group.

2. A receiver sheet according to claim 1, in which the first compound is an amine resin.

3. A receiver sheet according to claim 2 in which the amine resin is a melamine resin.

4. A receiver sheet according to claim 3 in which the melamine resin is hexamethoxymethyl melamine.

5. A receiver sheet according to claim 1 in which the functional group of the fluorine containing compound is hydroxy or thiol.

6. A receiver sheet according to claim 5 in which the fluorine containing compound has the formula.

$$C_nF_{2n+1}SO_2-\overset{\overset{\displaystyle R^1}{|}}{N}-CH_2R^2$$

where $R^1$ is an alkyl or substituted alkyl group having from 1 to 6 carbon atoms, or an aryl or substituted aryl group;

$R^2$ is $-COO-[CH(CH_3)CH_2OCH_2CH_2O-]_wR^3$, $-COO-(CH_2-CH_2O-)_xR^3$, or $-CH_2-O-(CH_2-CH_2-O-)_yR^3$;

$R^3$ is H;

n is an integer of from 4 to 20; and w, x and y each independently represents an integer of from 2 to 50.

7. A receiver sheet according to claim 6 in which the fluorine containing compound is selected from

1)

$$C_8F_{17}SO_2\overset{\overset{\displaystyle CH_3}{|}}{N}-CH2CO-O-\left(\overset{\overset{\displaystyle CH_3}{|}}{CH}-CH_2-O-CH_2CH_2-O\right)_{10-20}H$$

2)

$$C_8F_{17}SO_2\overset{\overset{\displaystyle C_2H_5}{|}}{N}-CH_2-CO-O-\left(CH_2-CH_2-O\right)_{40}-H$$

3)

$$C_8F_{17}SO_2\overset{\overset{\displaystyle C_2H_5}{|}}{N}-\left(CH_2-CH_2-O\right)_{2-30}H$$

8. A receiver sheet according to claim 1, in which the dye receptive polymer is an amophous polyester, a sulphonated polyester or a vinylchloride/vinyl acetate copolymer.

* * * * *